United States Patent [19]

Cruickshank

[11] 4,259,929

[45] Apr. 7, 1981

[54] ROTARY INTERNAL COMBUSTION ENGINE

[76] Inventor: Thomas Cruickshank, 275 Shuter St., Apt. 1212, Toronto, Ontario, Canada, M5A-1W4

[21] Appl. No.: 47,943

[22] Filed: Jun. 12, 1979

Related U.S. Application Data

[63] Continuation-in-part of Ser. No. 889,643, Mar. 24, 1978, abandoned.

[51] Int. Cl.[3] ..... F02B 57/00

[52] U.S. Cl. ..... 123/43 C

[58] Field of Search ..... 91/472, 491, 492; 123/43 R, 43 C, 44 E, 55 AA

[56] References Cited

U.S. PATENT DOCUMENTS

| | | | |
|---|---|---|---|
| 791,071 | 5/1905 | Bartosik | 123/43 R |
| 1,229,001 | 6/1917 | Well | 123/229 |
| 1,627,403 | 5/1927 | Outcelt | 123/44 E X |
| 2,558,349 | 6/1951 | Fette | 123/44 E |
| 3,731,661 | 5/1973 | Hatfield et al. | 123/43 C |
| 3,747,574 | 7/1973 | Bland | 123/43 C X |

FOREIGN PATENT DOCUMENTS

| | | | |
|---|---|---|---|
| 1102475 | 3/1961 | Fed. Rep. of Germany | 123/43 C |

*Primary Examiner*—Michael Koczo, Jr.

[57] ABSTRACT

A rotary internal combustion engine comprising a rotatable gear ring disposed between axially spaced first and second casings, the gear ring having teeth disposed internally thereon, piston-cylinder units fixed to the gear ring and moveable therewith, first and second annular cam rings mounted in the first and second casings, respectively, and rotatable in the same direction as the gear ring, the cam rings being in engagement with piston portions of the piston-cylinder units, and a drive gear having teeth interconnected with the gear ring and rotatable responsive to rotation of the gear ring, the speed of the cam rings being selectively variable to selectively vary the speed of the compression strokes of the engine.

10 Claims, 4 Drawing Figures

ROTARY INTERNAL COMBUSTION ENGINE

CROSS REFERENCE TO RELATED APPLICATION

This is a continuation-in-part of application Ser. No. 889,643, filed Mar. 24, 1978 in the name of Thomas Cruickshank, and now abandoned.

BACKGROUND OF THE INVENTION

1. Field of the Invention

This invention relates to internal combustion engines and is directed more particularly to an internal combustion engine of the rotary type.

2. Description of the Prior Art

Rotary internal combustion engines are generally known in the art. For example, U.S. Pat. No. 791, 071, issued May 30, 1908 to J. Bartosik, discloses an internal combustion engine in which the cylinders are stationary and reciprocating movement of the pistons operates a linkage system which induces rotary movement to a crankshaft. U.S. Pat. No. 1,627,403, issued May 3, 1927 to H. J. Outcelt shows an internal combustion engine in which reciprocation of pistons in cylinders causes rotation of a cylinder housing. Each cylinder is in axial alignment with a drive shaft and rotates about that point, remaining in axial alignment therewith. In U.S. Pat. No. 3,731,661, issued May 8, 1973 to Thomas J. Hatfield et al, there is shown an engine in which cylinders are mounted on a rotatable element. In the Hatfield apparatus, the stroke length of the pistons may be varied.

SUMMARY OF THE INVENTION

An object of the present invention is to provide a rotary internal combustion engine in which the stroke length is constant, but in which the speed of the stroke is variable to promote ideal compression periods in the operation of the engine.

A further object is to provide such an engine in which the speed of the compression stroke in a piston-cylinder unit may be selectively determined and may be varied during operation of the engine.

With the above and other objects in view, as will herein-after appear, a feature of the present invention is the provision of a rotary internal combustion engine comprising a frame, axially spaced first and second casings attached to the frame, an annularly-shaped rotatable gear ring disposed between the first and second casings, the gear ring having teeth disposed internally thereon, piston-cylinder units fixed to the gear ring and movable therewith, first and second annular cam rings mounted, respectively, in the first and second casings and rotatable in the same direction as the gear ring, the cam rings being in engagement with piston portions of the piston-cylinder units and determining movement of the pistons in the piston-cylinder units, and a drive gear having external teeth interconnected with the gear ring teeth and rotatable responsive to rotation of the gear ring.

In accordance with a further feature of the invention, the first and second casings are provided with recesses in which are disposed the rotatable annularly-shaped first and second cam rings, the cam rings having groove means for receiving projection means of the piston portions of the cylinder units.

The above and other features of the invention, including various novel details of construction and combinations of parts will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

DESCRIPTION OF THE DRAWINGS

Reference is made to the accompanying drawings in which is shown an illustrative embodiment of the invention from which its novel features and advantages will be apparent.

In the drawings.

DESCRIPTION OF THE PREFERRED EMBODIMENT

Figure 1:
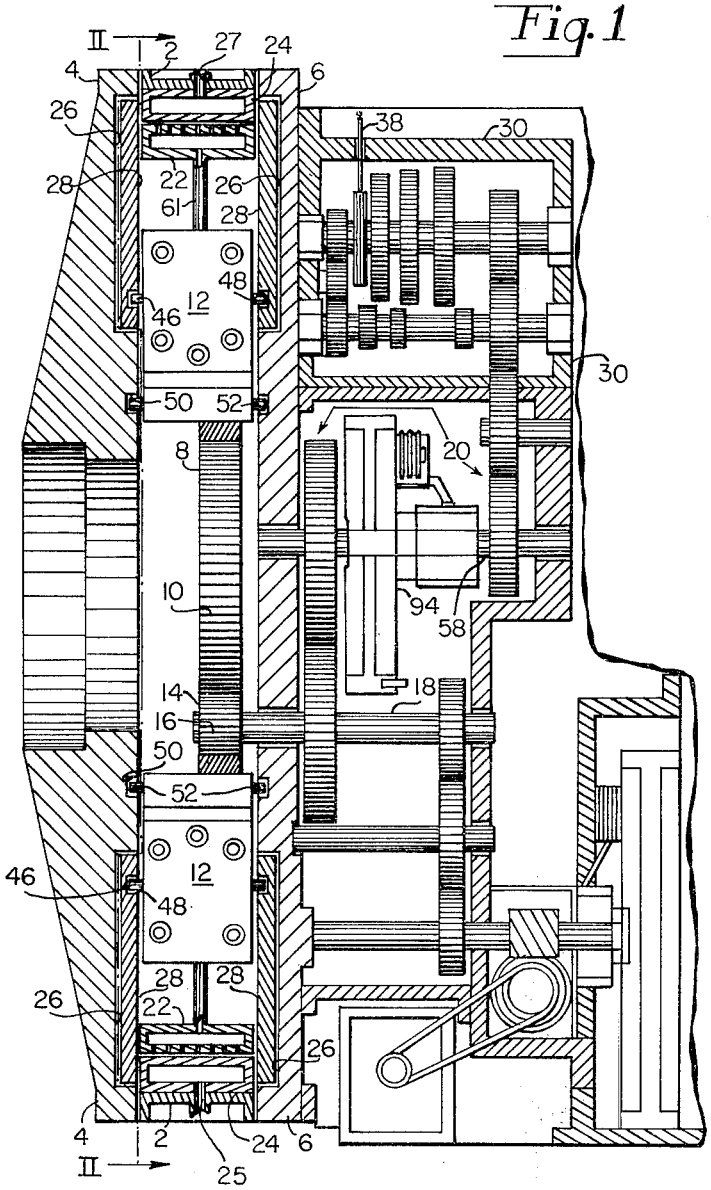
FIG. 1 is a side elevational view, partly broken away and partly in section, of an internal combustion engine illustrative of an embodiment of the invention.

Referring to FIG. 1, it will be seen that the illustrative embodiment includes a frame 2 to which is attached a first casing 4 and a second casing 6. An annular gear ring 8 is disposed between the first and second casings and is provided with teeth 10 (FIG. 2) directed inwardly of the ring on an inner circular surface thereof.

Piston-cylinder units 12 are secured to the gear ring 8, the cylinders being fixed thereto and moveable with the gear ring in a circular path.

A drive gear 14 having external teeth 16 interconnected with the gear ring teeth 10 is rotatable responsive to rotation of the gear ring 8 and operative to drive a shaft 18 connected to a gear train 20. Attached to the piston-cylinder units 12 is an annularly-shaped exhaust ring 22 moveable in conjunction with the piston-cylinder units 12. The exhaust ring 22 is provided with perforations 21 in its outer surface which allow escape of exhaust gases therethrough to stationary outlets 23 in the frame 2. The stationary outlets 23 lead to conduits 29 which in turn direct the exhaust gases to a muffler system (not shown). A stationary cooling jacket 24 is connected to the frame 2 and the exhaust ring 22 is moveable therein between the first and second casings 4, 6. A cooling fluid inlet 25 and outlet 27, facilitate movement of cooling fluid to and from the cooling jacket.

The first and second casings 4, 6 are provided with annularly-shaped recesses 26 in which are moveably disposed first and second cam rings 28. As may be seen in FIG. 1, a cam ring 28 is disposed on either side of the piston-cylinder units 12. The cam rings 28 are movable in a rotative manner in the same direction as the gear ring 8. The first and second casings 6, 4 are provided with annular grooves 50 which receive annular bearings 52 on the gear ring 8.

Figure 4:
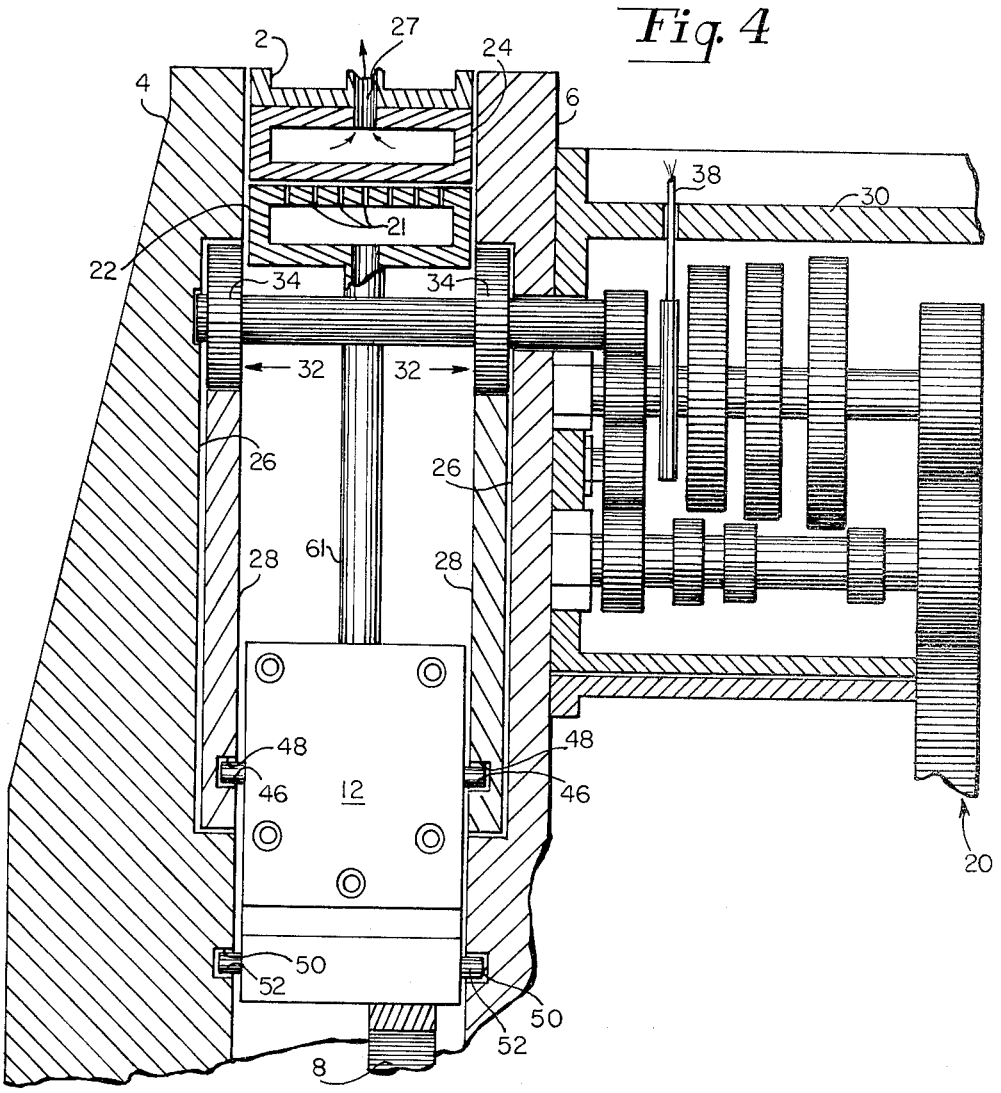
FIG. 4 is a detailed view of a cam ring drive means.

Referring again to FIG. 1, it will be seen that one of the gear trains 20 operating off the drive shaft 18 enters a gear box 30 from which there extends a cam ring drive gear 32 (FIG. 4) which has teeth 34 engaged with teeth 36 about the periphery of the cam rings 28. Thus, rotation of the gear ring 8 through the gear train 20 operates to drive the cam ring drive gear 32 and thereby the cam rings 28. A gear shift linkage 38 extend into the gear box 30 and is operable to shift gears, whereby to vary the speed of rotation of the cam rings 28. Manipulation of the gear shift linkage 38 is operable to change the speed of the cam rings, and thereby the speed of the combustion strokes, as will be further discussed below.

The piston-cylinder units 12 comprise cylinders 40 having pistons 42 therein. The pistons 42 are attached to backing plates 44 having compression pins 46 extending from either side thereof. The cam rings 28 are each provided with a groove 48 for receiving the compression pins 46. As will be seen in FIG. 2, the configuration of the groove 48 is such as to determine movement of the pistons 42 in the cylinders 40 as the piston-cylinder units 12 move in a circular path.

Figure 3:
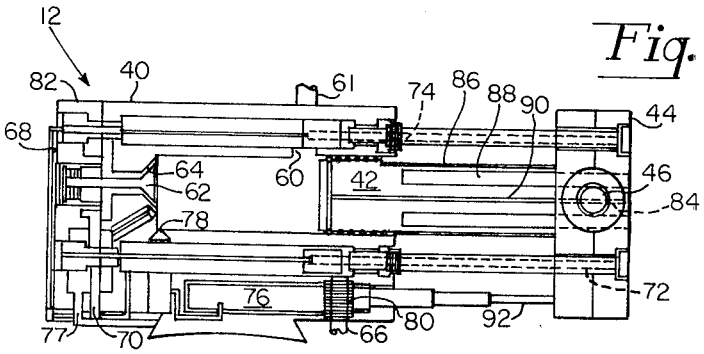
FIG. 3 is a detailed view, partly broken away, and partly in section of a piston-cylinder unit.

Referring to FIG. 3, it will be seen that each cylinder is provided with an exhaust port 60, a compressed air valve 62, compressed air nozzle 64, channels serving as conduits for coolant 66, lubricating oil 68, compressed air 70, and serving as return lines for the same 72 (coolant), 74 (lubricating oil). Each cylinder is secured to the main gear ring and is provided with a fuel pump 76, fuel injection nozzle 78, and fuel pump control mechanism 80. Preferably, each cylinder is provided with a cooling jacket 82.

Each backplate 44, which is attached to a piston 42, is provided with coolant lines 84 for cooling the pistons 42. Each backplate 44 has attached thereto a guide rod 86, in which are disposed passages for coolant 88 and lubricating oil 90 for compression rings. Further attached to the backplate is a telescoping fuel pump plunger 92. Preferably, the piston-cylinder units 12 are of the compression-ignition type.

A multiple split unit delivery system, not shown here but known in the art, delivers fuel, lubricating oil compressed air, coolant, and the like, and return lines therefore, serve the piston-cylinder units. A first portion of the multiple split unit system revolves with the piston-cylinder units, while a second portion thereof remains stationary. Sealants interface at the revolving and stationary surfaces. Passageways (not shown) are disposed in the gear ring at the piston-cylinder locations to accomodate conduits connected to the multiple unit delivery system first portion.

In utilizing the invention, a suitable air and fuel mixuture is supplied through conduits 70 (air), 77 (fuel) to the cylinders as the cylinders are moving forwardly and the pistons are reciprocated therein, the mixture being compressed in each cylinder as its piston moves (relatively) toward the top thereof during the compression stroke of the piston. Upon ignition in the usual manner, the cylinder is forced forwardly, causing relative movement of the piston toward bottom and facilitating exhaustion of the burned mixture through the exhaust ports 60, into exhaust pipes 61 and thence into the exhaust ring 22. During a cycle of operation, the intake and exhaust ports of each cylinder operate in accordance with known principles to admit the air-fuel mixture and exhaust the burned gases at appropriate times in the cycle.

Figure 2:
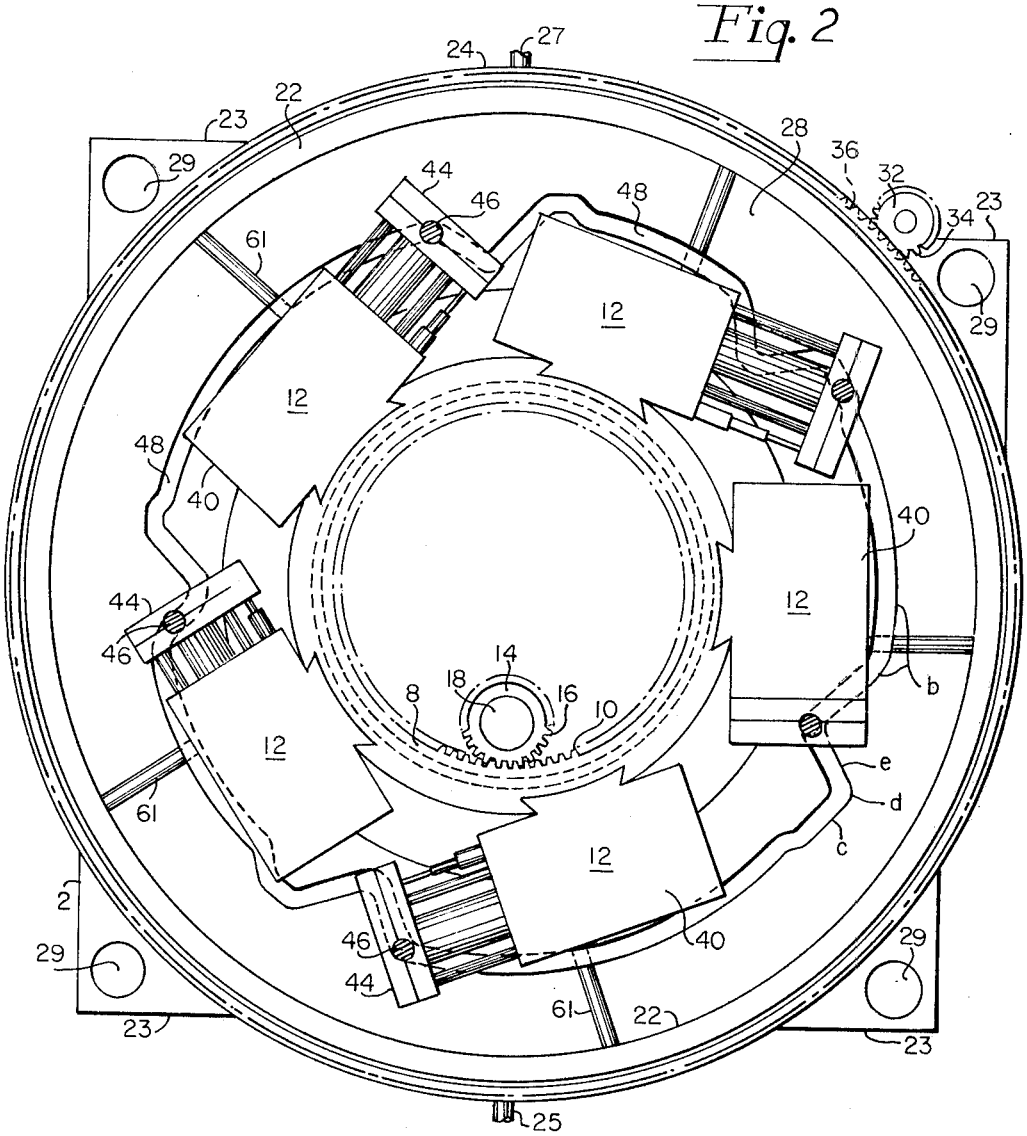
FIG. 2 is a sectional view of the apparatus of FIG. 1, taken along line II—II of FIG. 1.

In the illustrative embodiment, the gear ring 8 has mounted thereon five of the piston-cylinder units 12. The firing order is 1, 3, 5, 2, 4, the firing order being achieved through the configuration of the grooves 48. In the five cylinder embodiment, the cylinders are spaced at intervals such that a complete piston-cylinder cycle of operation occurs every 144°. Referring particularly to FIG. 2, the groove 48 of the compression ring 28 includes a portion b which urges the piston forwardly (the cam ring 28 and main gear ring 8 rotate counterclockwise as viewed in FIG. 2) into the cylinder, effecting a compression stroke, a portion c at which top dead center is reached, a portion d at which combustion occurs, and a portion e at which the power stroke occurs.

In operation, firing of the piston-cylinder units 12 causes a forward thrust of the cylinders 40, the forward movement of the cylinders causing rotation of the gear ring 8 and, through the operation of the drive gear 14 and gear train 20, the rotative movement of the drive gear 32, and thereby; the cam rings 28. By manipulation of the gear shift linkage 38, the speed of rotation of the cam rings 28 may be varied. The compression strokes are determined by the eccentric configuration of the grooves 48 in the cam rings 28, the grooves being operable in their rotative movement to periodically urge the compression pins 46 forwardly, thereby causing rapid forward movement of the backing plates 44 and the pistons 42, driving the pistons 42 into the cylinders 40 in a compression stroke. Upon firing of the piston-cylinder unit, the cylinder 40 is driven forwardly of the piston 42, imparting rotative thrust to the gear ring 8 to which the piston-cylinder unit 12 is attached. At this point the configuration of the grooves 48 "holds" the piston from backward movement and the combustion power forces the cylinder forward. The grooves 48 then facilitate return of the piston to an extended position. The power stroke of the engine is provided as the cylinder is pushed forward by the expansion of the combustion gases. The piston at the top of dead center is moving forward more slowly than its cylinder, causing distance to develop between the cylinder and the piston until the piston reaches the bottom if its stroke. Movement of the pistons in the cylinders is caused by movement of the compression pins 46 in the eccentric grooves 48 of the cam rings 28.

A starting motor 56 may be utilized for purposes of starting the engine.

A main drive shaft 58 and clutch assembly 94 may be utilized to transmit rotary power to selected operating apparatus.

Omitted from the drawings for the sake of clarity are the appropriate air lines, fuel lines, fuel pumps, lubricating oil pumps, oil storage means, trottle control rods, coolant lines, coolant pumps, and the like, necessary for the operation of the engine. Compressed air fittings may also be included in the assembly to facilitate use of the engine as an air compressor in accordance with known principles.

It is to be understood that the present invention is by no means limited to the particular construction herein disclosed and/or shown in the drawings, but also comprises any modifications or equivalents within the scope of the disclosure.

Having thus described my invention, what I claim as new and desire to secure by Letters Patent of the United States is:

1. A rotary internal combustion engine comprising a frame, axially spaced end casings attached to said frame, an annularly-shaped rotatable gear ring disposed between said end casings, said gear ring having teeth disposed internally thereon, piston-cylinder units fixed to said gear ring and moveable therewith, annular cam rings mounted in said end casings respectively, gear train means interconnecting said gear ring and said cam rings for turning said cam rings in the same direction as said gear ring, said cam rings having grooves therein, piston portions of said piston-cylinder units having protrusions disposed in said grooves, said cam rings thereby determining movement of said piston portions in said piston-cylinder units.

2. The invention according to claim 1 including an annularly-shaped exhaust chamber connected to said piston-cylinder units and moveable with said piston-cylinder units between said outer and inner casings.

3. The invention according to claim 2 including a cooling jacket disposed about said exhaust chamber.

4. The invention according to claim 1 in which a first of said cam rings is disposed in a recess in a first of said end casings, said first cam ring having a first of said grooves therein, and a first of said protrusions extending from each of said piston-cylinder units disposed in said first groove.

5. The invention according to claim 4 in which a second of said cam rings is disposed in a recess in a second of said end casings, said second cam ring having a second of said grooves therein, and a second of said protrusions extending from each of said piston-cylinder units disposed in said second groove.

6. The invention according to claim 5 in which said first and second end casings are provided with third and fourth grooves, respectively, in which are disposed protrusion means of said gear ring.

7. The invention according to claim 5, in which said gear train means includes drive means engaged with the peripheries of said first and second rings for rotating said first and sedond rings, variable speed gear means connected to said drive means, and drive gear means connected to said variable speed gear means and in engagement with said gear ring.

8. The invention according to claim 7 in which said variable speed gear means includes means for varying the speed of said first and second cam rings relative to said drive gear.

9. The invention according to claim 7 in which the configuration of said first and second grooves is such as to periodically urge said piston portions into their respective cylinders in compression strokes during operative rotation of said gear ring and said cam rings.

10. The invention according to claim 9 in which said cam rings and said gear ring move at different speeds and said means for varying the speed of said cam rings is operable to vary such difference to vary the speed of said compression strokes.

* * * * *